US007100810B1

(12) United States Patent
Bosch et al.

(10) Patent No.: US 7,100,810 B1
(45) Date of Patent: Sep. 5, 2006

(54) PAINTBALL POD HOLDER SYSTEMS

(76) Inventors: John P. Bosch, 8502 E. Via de Ventura, #101, Scottsdale, AZ (US) 85258; Clyde McKay, 8502 E. Via de Ventura, #101, Scottsdale, AZ (US) 85258

( * ) Notice: Subject to any disclaimer, the term of this patent is extended or adjusted under 35 U.S.C. 154(b) by 0 days.

(21) Appl. No.: 10/984,257

(22) Filed: Nov. 8, 2004

Related U.S. Application Data

(60) Provisional application No. 60/520,057, filed on Nov. 14, 2003.

(51) Int. Cl.
*A45F 5/00* (2006.01)

(52) U.S. Cl. ..... 224/682; 224/684; 224/231; 224/196; 224/931

(58) Field of Classification Search ..... 224/682, 224/684, 231, 676, 660, 119, 603, 223, 235, 224/236, 901.2, 901.4, 901.6, 196, 931; 383/119
See application file for complete search history.

(56) References Cited

U.S. PATENT DOCUMENTS

| | | | | | |
|---|---|---|---|---|---|
| 3,274,476 | A * | 9/1966 | Wildum | 320/112 |
| 4,330,073 | A * | 5/1982 | Clark | 224/223 |
| 4,449,654 | A * | 5/1984 | Cappis | 224/148.6 |
| 4,613,068 | A * | 9/1986 | Bianchi | 224/242 |
| 4,867,360 | A * | 9/1989 | Howard | 224/245 |
| 5,002,401 | A * | 3/1991 | Blackman | 383/38 |
| 5,190,196 | A * | 3/1993 | Hamer, III | 224/625 |
| 5,240,158 | A * | 8/1993 | Walsh | 224/677 |
| 5,351,866 | A * | 10/1994 | Foss | 224/148.4 |
| 5,470,001 | A * | 11/1995 | Konchan | 224/673 |
| 5,503,316 | A * | 4/1996 | Stewart | 224/312 |
| 5,647,378 | A * | 7/1997 | Farnum | 128/876 |
| 5,702,042 | A | 12/1997 | Peacock | |
| 5,931,363 | A * | 8/1999 | Ammons, Jr. | 224/602 |
| 6,003,746 | A * | 12/1999 | Richardson | 224/200 |
| 6,076,715 | A * | 6/2000 | Easter | 224/149 |
| 6,158,642 | A | 12/2000 | Herbage | |
| 6,234,157 | B1 | 5/2001 | Parks | |
| 6,405,912 | B1 * | 6/2002 | Giannou | 224/679 |
| D460,502 | S | 7/2002 | Traum et al. | |
| 6,418,919 | B1 | 7/2002 | Perrone | |
| 6,467,473 | B1 | 10/2002 | Kostiopoulos | |
| 6,481,432 | B1 | 11/2002 | Rushton et al. | |
| 6,488,019 | B1 | 12/2002 | Kotsiopoulos | |
| 6,508,384 | B1 | 1/2003 | Tien et al. | |
| 6,546,599 | B1 * | 4/2003 | Pelt et al. | 24/3.1 |
| 6,641,015 | B1 * | 11/2003 | Huggins, Jr. | 224/674 |
| D483,561 | S * | 12/2003 | Charpentier | D3/221 |
| 6,698,632 | B1 * | 3/2004 | Turner et al. | 224/196 |
| 6,913,176 | B1 * | 7/2005 | Buscemi | 224/665 |
| 6,962,278 | B1 * | 11/2005 | Obatake | 224/681 |
| 2004/0031836 | A1 * | 2/2004 | Garcia | 224/665 |
| 2004/0144823 | A1 * | 7/2004 | Obatake | 224/684 |
| 2004/0222258 | A1 * | 11/2004 | Ho et al. | 224/191 |

* cited by examiner

*Primary Examiner*—Nathan J. Newhouse
*Assistant Examiner*—Justin M. Larson
(74) *Attorney, Agent, or Firm*—Stoneman Law Offices, Ltd.; Martin L. Stoneman; Daphne G. Foley

(57) ABSTRACT

This invention provides a paintball pod holder system for convenient one-handed removal and replacement of paintball pods. Preferably, one or more rigid paintball pod holders are attached to a belt or other support. A stiff lining of the inside of the paintball pod holder keeps the holder open at the ends and permits convenient insertion of paintball pods. The lining also has a spring clip function to securely hold the paintball pod. There is also a non-slip surface to prevent the system from slipping against the body during use.

23 Claims, 4 Drawing Sheets

412
412
704
702
300
503
412
412
410
102
703
701
502
501
101
700

412
412
503
412
412
410
102
502
501
101

412
412
300
503
412
412
410
102
502
501
101

504
102
411
410
412
411
503
502
504
501
5
5
101

PAINTBALL POD HOLDER SYSTEMS

CROSS-REFERENCE TO RELATED APPLICATION

The present application is related to and claims priority from prior provisional application Ser. No. 60/520,057, filed Nov. 14, 2003, entitled "PAINTBALL POD HOLDER SYSTEM", the content of which is incorporated herein by this reference and is not admitted to be prior art with respect to the present invention by the mention in this cross-reference section.

BACKGROUND

This invention relates to providing improved paintball pod holder systems. More particularly, it relates to providing a paintball pod holder system that provides easy access to a large number of stored paintballs.

Typically, paintballs are stored and transported within paintball pods. Some paintball pods have a flip-top or screw-on cap. Paintball pods are typically carried in paintball pod holders carried by the player.

Paintball pod holders fall into two general categories: semi-rigid and elastic. Semi-rigid paintball pod holders are typically made of fabric, padded nylon, or neoprene. They have the disadvantage of being difficult to manufacture. Semi-rigid paintball pod holders must be exactly the correct size to securely and removably hold a paintball pod. If the holder is too tight, it becomes difficult to insert and remove the paintball pod. If the holder is too loose, the paintball pod will move within the holder, causing both noise and inconvenience in a paintball combat situation. Also, a loose pod may fall out of the holder and spill its load of paintballs on the ground. Dirty paintballs cannot be used in a paintball gun, so this is a great inconvenience for a player.

Elastic paintball pod holders have the disadvantage of requiring two hands to load a paintball pod into the elastic paintball pod holder, which requires the player to put down her paintball gun. During a paintball game, it can be very inconvenient to place an empty paintball pod back into the elastic paintball pod holder on a backpack or waist-pack. Elastic paintball pod holders also have the disadvantage of being flexible enough to permit a paintball pod to slip loose during vigorous play.

Paintball pod holders are typically made of heavy-duty nylon, which is very slippery. The slipperiness of the nylon permits a paintball pod holder to slip and slide against the user, especially when running. This movement is noisy and annoying.

Therefore, a need exists for a paintball pod holder system that overcomes the above-stated disadvantages. More particularly, a paintball pod holder that is easy to load and unload and which securely and quietly holds paintball pods during play is needed.

OBJECTS AND FEATURES OF THE INVENTION

A primary object and feature of the present invention is to overcome the above-stated disadvantages and meet the above-stated needs. Another primary object and feature of the present invention is to provide paintball pod holder systems.

A further object and feature of the present invention is to provide such a system that permits one-handed insertion and removal of a paintball pod. It is yet a further object and feature of the present invention to provide such a system that securely holds ordinary paintball pods despite moderate variations in the sizes of ordinary paintball pods. An additional object and feature of the present invention is to provide a system that prevents paintball pods from moving within the paintball pod holder.

It is a further object and feature of the present invention to provide such a system that is wearable and does not substantially slip or move against the wearer.

A further primary object and feature of the present invention is to provide such a system that is efficient, inexpensive, and handy. Additional objects and features of this invention will become apparent with reference to the descriptions provided herein.

SUMMARY OF THE INVENTION

In accordance with a preferred embodiment hereof, this invention provides a paintball pod holder system, for use by at least one user playing paintball, comprising: paintball pod holder means, having at least one length and at least one periphery, for holding at least one paintball pod; wearable article means for supporting such paintball pod holder means; stiffener means, having at least one inner surface, for stiffening such at least one length of such paintball pod holder means; and peripheral friction controller means for controlling peripheral friction exerted on the at least one paintball pod by such at least one inner surface of such stiffener means when the at least one paintball pod is situate within such paintball pod holder means. Moreover, it provides such a paintball pod holder system, further comprising non-slip surface means for securing such wearable article means, when worn by the at least one user, against slipping.

In accordance with another preferred embodiment hereof, this invention provides a paintball pod holder system, for use by at least one user playing paintball, comprising: at least one paintball pod holder, having at least one length and at least one periphery, structured and arranged to hold at least one paintball pod; at least one wearable article structured and arranged to support such at least one paintball pod holder; at least one stiffener, having at least one inner surface, adapted to stiffen such at least one length of such at least one paintball pod holder; and at least one peripheral friction controller structured and arranged to control at least one peripheral frictional force exerted by such at least one inner surface of such at least one stiffener when the at least one paintball pod is situate within such at least one paintball pod holder.

Additionally, it provides such a paintball pod holder system, further comprising at least one non-slip surface structured and arranged to secure such at least one wearable article, when worn by the at least one user, against slipping. Also, it provides such a paintball pod holder system, wherein such at least one wearable article comprises at least one adjustably-closeable belt adapted to adjustably close about at least one waist of the at least one user. In addition, it provides such a paintball pod holder system, wherein such at least one paintball pod holder comprises at least one fabric.

And, it provides such a paintball pod holder system, wherein such at least one paintball pod holder comprises at least one portion of such at least one wearable article. Further, it provides such a paintball pod holder system, wherein such at least one stiffener comprises at least one plastic. Even further, it provides such a paintball pod holder system, wherein such at least one plastic comprises at least one polyurethane. Moreover, it provides such a paintball pod holder system, wherein such at least one plastic comprises at least one thin flat sheet.

Additionally, it provides such a paintball pod holder system, wherein such at least one stiffener lies at least between at least one portion of such at least one paintball pod holder and the at least one paintball pod when the at least one paintball pod is situate in such at least one paintball pod holder. Also, it provides such a paintball pod holder system, wherein such at least one peripheral friction controller comprises at least one spring clip adapted to resiliently force such at least one inner surface of such at least one stiffener against the at least one paintball pod when the at least one paintball pod is situate in such at least one paintball pod holder. In addition, it provides such a paintball pod holder system, wherein such at least one peripheral friction controller comprises at least one frictional surface structured and arranged to control at least one coefficient of friction of such at least one inside surface of such at least one paintball pod holder. And, it provides such a paintball pod holder system, further comprising the at least one paintball pod.

Further, it provides such a paintball pod holder system, further comprising at least one paintball pod ejector adapted to at least partially eject the at least one paintball pod from such at least one paintball pod holder. Even further, it provides such a paintball pod holder system, wherein such at least one paintball pod ejector comprises at least one non-slip surface adapted to assist preventing slipping between such at least one paintball pod ejector and the at least one paintball pod. Moreover, it provides such a paintball pod holder system, wherein such at least one non-slip surface comprises at least one neoprene pad.

Additionally, it provides such a paintball pod holder system, wherein such at least one stiffener comprises at least about fifty percent of such at least one length of such at least one paintball pod holder. Also, it provides such a paintball pod holder system, wherein such at least one stiffener comprises substantially all of such at least one length of such at least one paintball pod holder. In addition, it provides such a paintball pod holder system, wherein such at least one stiffener is substantially centered along such at least one length of such at least one paintball pod holder.

In accordance with another preferred embodiment hereof, this invention provides a paintball pod holder system, for use by at least one user playing paintball, comprising: at least one paintball pod holder, having at least one length and at least one periphery, structured and arranged to hold at least one paintball pod; at least one wearable article structured and arranged to support such at least one paintball pod holder; and at least one non-slip surface structured and arranged to secure such at least one wearable article, when worn by the at least one user, against slipping.

And, it provides such a paintball pod holder system, further comprising: at least one stiffener, having at least one inner surface, adapted to stiffen at least one length of such at least one paintball pod holder; and at least one peripheral friction controller structured and arranged to control at least one coefficient of friction of such at least one inside surface of such at least one paintball pod holder.

In accordance with another preferred embodiment hereof, this invention provides a paintball pod holder system, for use by at least one user playing paintball, comprising: at least one paintball pod holder, having at least one length and at least one periphery, structured and arranged to hold at least one paintball pod; at least one wearable article structured and arranged to support such at least one paintball pod holder; at least one non-slip surface adapted to secure such at least one wearable article against slipping on the at least one user during play; at least one stiffener, having at least one inner surface, adapted to stiffen such at least one length of such at least one paintball pod holder; and at least one peripheral friction controller structured and arranged to control at least one coefficient of friction of such at least one inside surface of such at least one paintball pod holder.

In accordance with another preferred embodiment hereof, this invention provides a paintball pod holder system, for use by at least one user playing paintball, comprising the steps of: providing at least one stiffener; providing at least one paintball pod holder; attaching such at least one stiffener to at least one interior of such at least one paintball pod holder; and attaching such at least one paintball pod holder to at least one wearable article.

Further, it provides such a paintball pod holder system, further comprising the step of attaching, in such manner as to impede slipping during play, at least one non-slip surface to such at least one wearable article. Even further, it provides such a paintball pod holder system, wherein the step of providing at least one stiffener further comprises the step of fabricating at least one peripheral friction controller. Even further, it provides such a paintball pod holder system, wherein the step of attaching such at least one stiffener to at least one interior of such at least one paintball pod holder further comprises the step of attaching such at least one stiffener along at least one portion of at least one inner surface of such at least one paintball pod holder. Even further, it provides such a paintball pod holder system, wherein the step of attaching such at least one stiffener comprises the step of sewing such at least one stiffener.

In accordance with another preferred embodiment hereof, this invention provides a paintball pod holder system, for use by at least one user playing paintball, comprising: a plurality of paintball pod holders, each having at least one length and at least one periphery and each being structured and arranged to hold at least one paintball pod, wherein each paintball holder of such plurality of paintball holders comprises at least one stiffener, having at least one inner surface, adapted to stiffen such at least one length of such at least one paintball pod holder; and at least one peripheral friction controller structured and arranged to control at least one coefficient of friction of such at least one inside surface of such at least one paintball pod holder; at least one belt structured and arranged to support such plurality of paintball pod holders; and at least one non-slip surface structured and arranged to secure such at least one wearable article, when worn by the at least one user, against slipping. Even further, it provides such a paintball pod holder system, further comprising at least one elastic paintball pod holder adapted to elastically hold at least one paintball pod.

DETAILED DESCRIPTION OF THE BEST MODES AND PREFERRED EMBODIMENTS OF THE INVENTION

Figure 1:
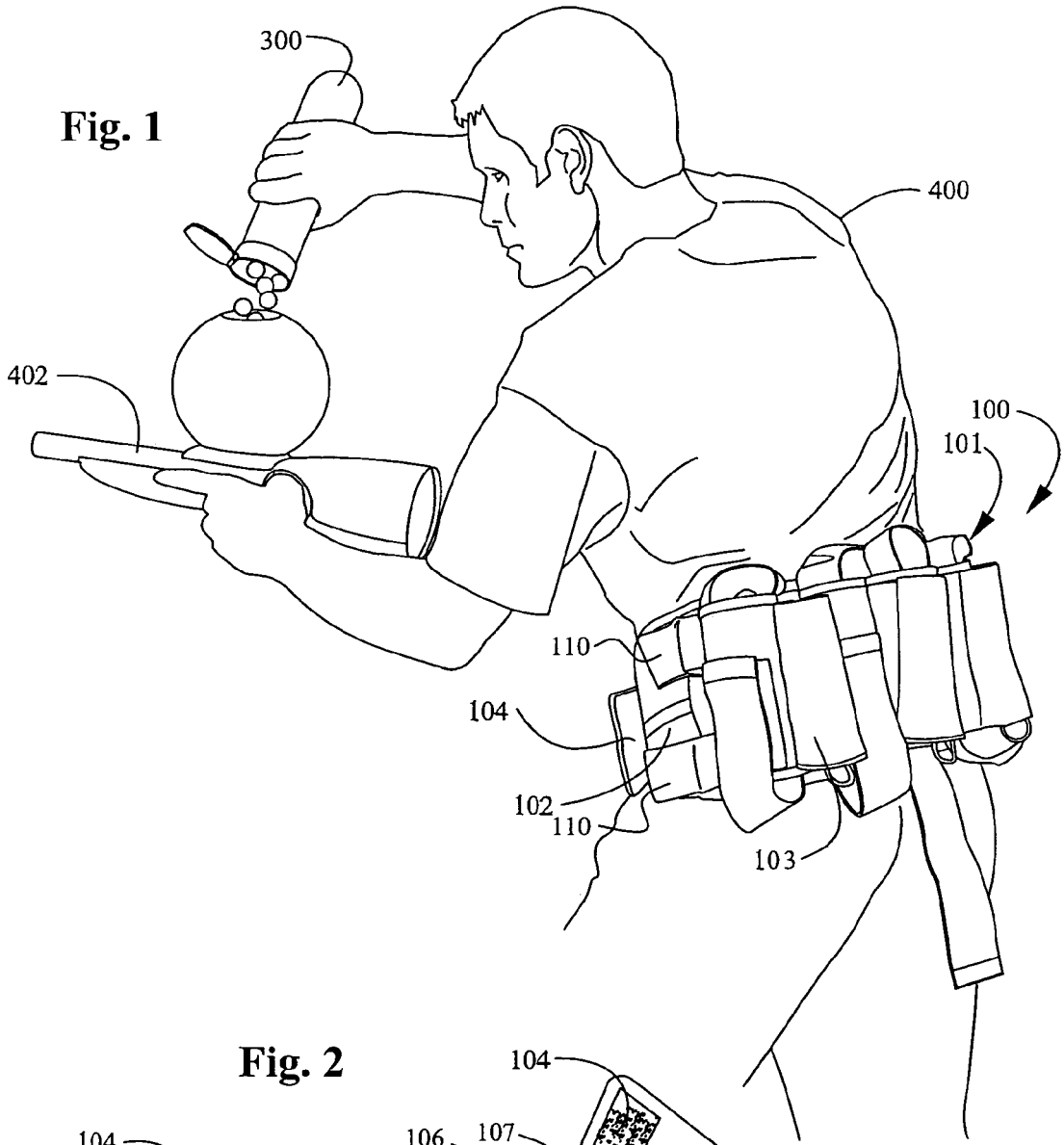
FIG. 1 shows a perspective view of a paintball pod holder system, in use, according to a preferred embodiment of the present invention.

FIG. 1 shows a perspective view of a paintball pod holder system 100 according to a preferred embodiment of the present invention. In this view, player 400 is wearing paintball pod holder system 100, preferably with multiple rigid paintball holders 101, and has one-handedly removed paintball pod 300 which player 400 is preferably using to reload paintball gun 402, as shown. After paintball gun 402 is reloaded, player 400 may preferably replace paintball pod 300 back into rigid paintball pod holder 101 using one hand.

In this preferred embodiment, belt 102 is compactly arranged with four rigid paintball holders 101, three elastic paintball pod holders 103, and two two-piece elastic paintball pod holders 110, together forming paintball pod holder system 100 (at least embodying herein the step of providing at least one paintball pod holder), as shown. Preferably, belt 102 closes with hook and loop fastener 104. Upon reading the teachings of this specification, those with ordinary skill in the art will now understand that, under appropriate circumstances, considering such issues as user preference, economics of manufacture, future technological advancements, etc., other numbers and arrangements of paintball pod holders having at least one rigid paintball pod holder, such as, for example, only one rigid paintball pod holder, five rigid paintball holders with four elastic paintball holders, etc., may suffice. Upon reading the teachings of this specification, those with ordinary skill in the art will now understand that, under appropriate circumstances, considering such issues as user preference, economics of manufacture, future technological advancements, etc., other means of wearing rigid paintball pod holder, such as bandoliers, straps, backpacks, vests, etc., may suffice.

Figure 2:
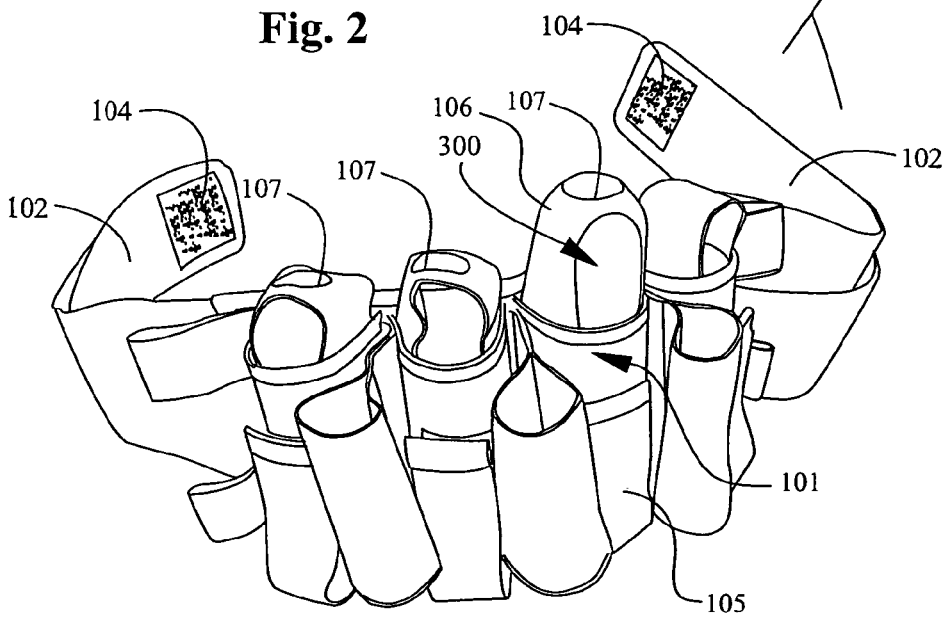
FIG. 2 shows a perspective view of the paintball pod holder system of FIG. 1, apart from the user.

FIG. 2 shows paintball pod holder system 100 according FIG. 1, with paintball pod 300 stored in rigid paintball pod holder 101. Rigid paintball pod holder 101 preferably has end closures such as, for example, hook and loop strap 105 (preferably on the bottom end) and elastic strap 106 (preferably on the top end), as shown. Preferably, paintball pod 300 is inserted into rigid paintball pod holder 101 until elastic strap 106 is under tension, and then hook and loop strap 105 is closed to hold paintball pod 300 in that position, as shown. Upon reading the teachings of this specification, those of skill in the art will understand that, under appropriate circumstances, other end closures, such as multiple elastic straps, permanent sewn closures, no closures, lids, etc., may suffice.

Elastic strap 106 preferably has non-slip pad 107 attached to the inside surface of elastic strap 106, as shown. Non-slip pad 107 preferably helps to prevent strap 106 from slipping off of the rounded end of paintball pod 300, thereby maximizing the effectiveness of elastic strap 106. Preferably, non-slip pad 107 comprises neoprene. Upon reading the teachings of this specification, those with ordinary skill in the art will now understand that, under appropriate circumstances, considering such issues as advances in technology, user preference, etc., other non-slip materials, such as rubber, adhesive, soft plastic, silicone rubber, dots of hot-melt glue, etc., may suffice.

Rigid paintball pod holder 101 preferably holds paintball pod 300 tightly enough around the perimeter of paintball pod 300 that paintball pod 300 will not easily fall out of rigid paintball pod holder 101 even when hook and loop strap 105 is open. This preferably permits player 400 to open hook and loop strap 105 and then grasp paintball pod 300 without paintball pod 300 slipping out of rigid paintball pod holder 101 and falling to the ground. Hook and loop strap 105 secures paintball pod 300 in rigid paintball pod holder 101 during vigorous play.

Figure 3:
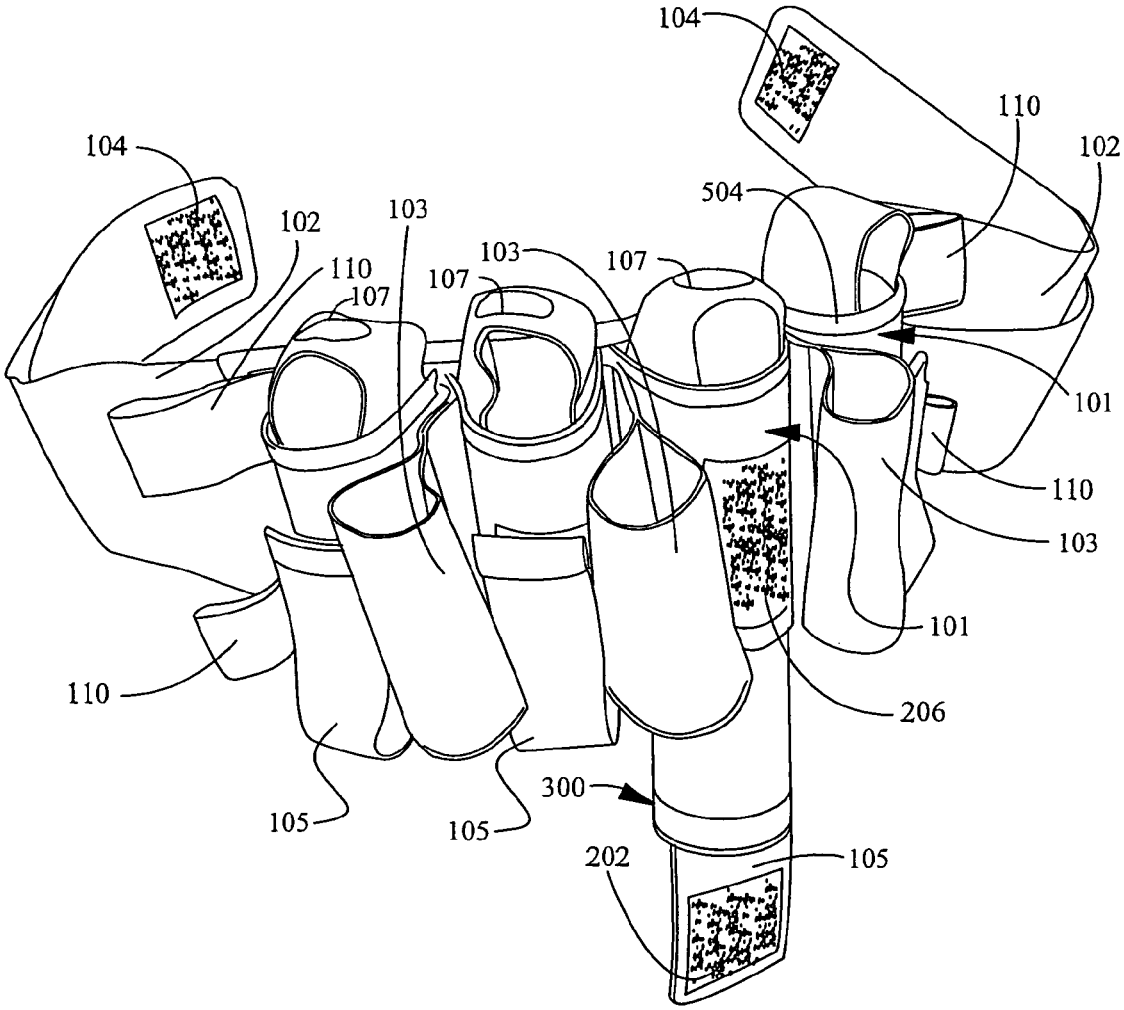
FIG. 3 shows a larger perspective view of the paintball pod holder system of FIG. 1.

Elastic strap 106 preferably allows paintball pod 300 to be held under tension in the vertical (long) axis, while rigid paintball pod holder 101 preferably securely holds paintball pod 300 around the perimeter of paintball pod 300, as shown. If paintball pod 300 is placed into rigid paintball pod holder 101 such that elastic strap 106 is under tension, paintball pod 300 will preferably be partially ejected from rigid paintball pod holder 101 when hook and loop strap 105 is released, making it easier for player 400 to grasp paintball pod 300 for fast use, as shown in FIG. 3. This vertical tension also helps prevent paintball pod 300 from shifting in rigid paintball pod holder 101 during active play.

FIG. 3 shows paintball pod holder system 100 according FIG. 1, with a paintball pod 300 partially ejected from rigid paintball pod holder 101. Rigid paintball pod holder 101 preferably securely and gently holds paintball pod 300 in this position, as shown, until player 400 chooses to grasp and pull paintball pod 300. The preferred placement of hook fastener 206 and loop fastener 202 is also shown.

Figure 4A:
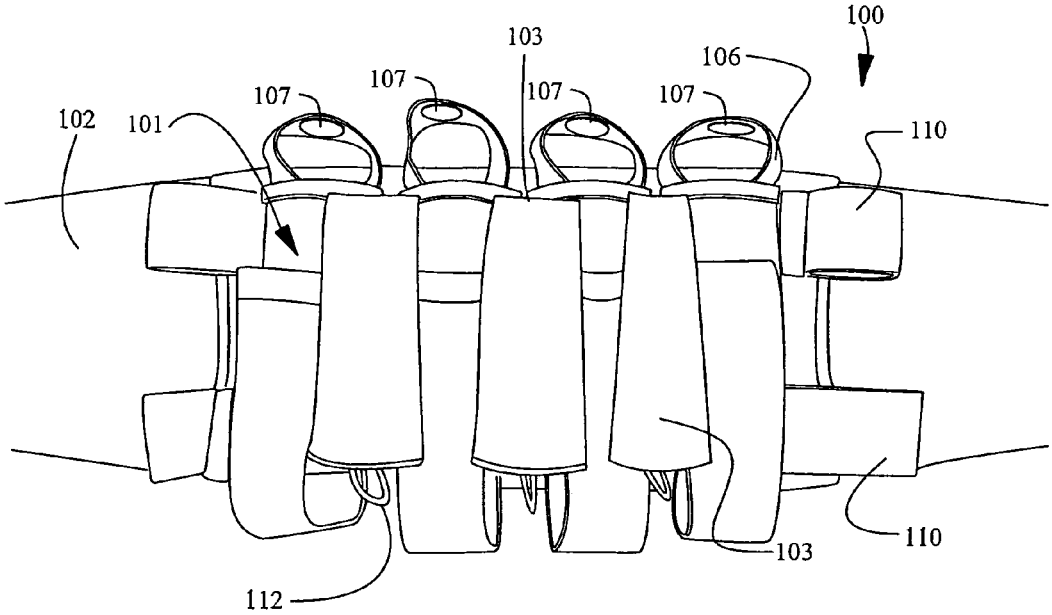
FIG. 4A shows a front view of the paintball pod holder system of FIG. 1.

FIG. 4A shows a front view of paintball pod holder system 100 according to the preferred embodiment of FIG. 1. This view makes clear the preferred arrangement for paintball pod holders in this preferred embodiment of paintball pod holder system 100. This preferred arrangement permits four rigid paintball pod holders 101, three elastic paintball pod holders 103, and two two-piece elastic paintball pod holders 110 to be compactly arranged on belt 102, as shown. Rigid paintball holders 101 are preferred for their novel ease of use and high level of security. Elastic paintball pod holders 103 provide additional holding capacity in a very compact way but require two hands to insert paintball pods 300; loops 112 on elastic paintball pod holders 103 preferably loop around tabs on the lids of typical paintball pods 300 to provide extra security against paintball pod 300 slipping out accidentally. Two-piece elastic paintball pod holders 110 provide surplus holding capacity, with minimal bulk and minimal security.

Paintball pod holders 101, 103, and 110 are preferably sized to hold paintball pods 300 of at least one standard size or capacity. Paintball pods 300 are typically round cylinders with one rounded end and one flat capped end, as shown. Paintball pods 300 are manufactured in several standard sizes or capacities, with moderately variable lengths and perimeters. Paintball pod holders 101, 103, and 110 are preferably resilient enough to each hold several sizes of paintball pod 300. In the present embodiment, rigid paintball pod holder 101 is preferably sized to hold both 100-round paintball pods and 140-round paintball pods, while elastic paintball pod holders 103 are preferably sized to hold both 10-round and 15-round paintball pods, as needed. Upon reading the teachings of this specification, those with ordinary skill in the art will now understand that, under appropriate circumstances, considering such issues as user preference, advances in technology, changes in the shape of paintball pods, availability of materials, etc., other sizes of paintball pod holders may suffice.

Figure 4B:
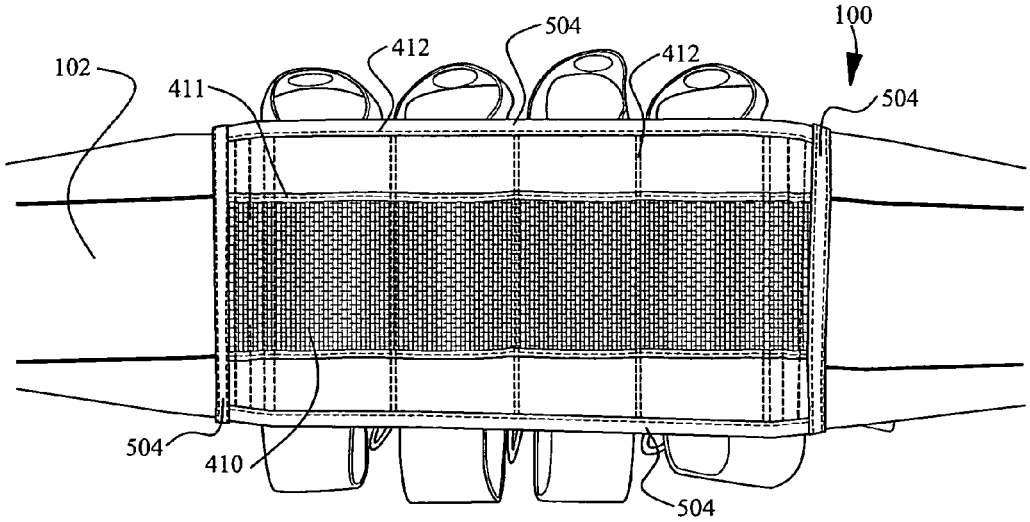
FIG. 4B shows a back view of the paintball pod holder system of FIG. 1.

FIG. 4B shows a back view of the paintball pod holder system 100 according FIG. 1. This back view shows a preferred placement of non-slip surface 410, as shown, such as, for example, neoprene fabric. Preferably, non-slip surface 410 at least partially covers the back of paintball pod holder system 100, as shown. As has been noted, slipping of the belt on the paintball player is very bothersome, inefficient, noisy, and interferes with enjoyable play. It has been found that specially providing an anti-slip surface (such as preferred surface 410) at least along the back of the belt, as shown and described herein, which assists in preventing such slipping, is highly beneficial to a player. Preferably, edge binding 411 is used to help secure non-slip surface 410, as shown. Preferably, non-slip surface 410 and edge binding 411 are sewn with stitches 412, as shown particularly in FIGS. 4B, 5, 6, 7, and 8 (at least embodying herein the step of attaching, in such manner as to impede slipping during play, at least one non-slip surface to such at least one wearable article). All of the dashed lines in FIGS. 4B, 5, 6, 7, and 8 indicate the preferred placement of stitches 412. Upon reading the teachings of this specification, those with ordinary skill in the art will now understand that, under appropriate circumstances, considering such issues as user preference, advances in technology, availability of materials, etc., other non-slip surfaces, such as nylon-backed neoprene, silicone treated fabric, spray-on non-stick surfaces, etc., may suffice. Upon reading the teachings of this specification, those with ordinary skill in the art will now understand that, under appropriate circumstances, considering such issues as user preference, intended use, type of wearable article, advances in technology, etc., other sizes and placements of non-stick surface, such as on the entire contact surface, on the elastic portions, on the belt, etc., may suffice.

Preferably, paintball pod holder system 100 is fabricated with attachers, preferably stitches 412, as shown. Upon reading the teachings of this specification, those with ordinary skill in the art will now understand that, under appropriate circumstances, considering such issues as technological advances, user preference, durability needs, etc., other attachers, such as adhesive, melt welding, rivets, etc., may suffice.

Figures 5, 6, 7, 8:
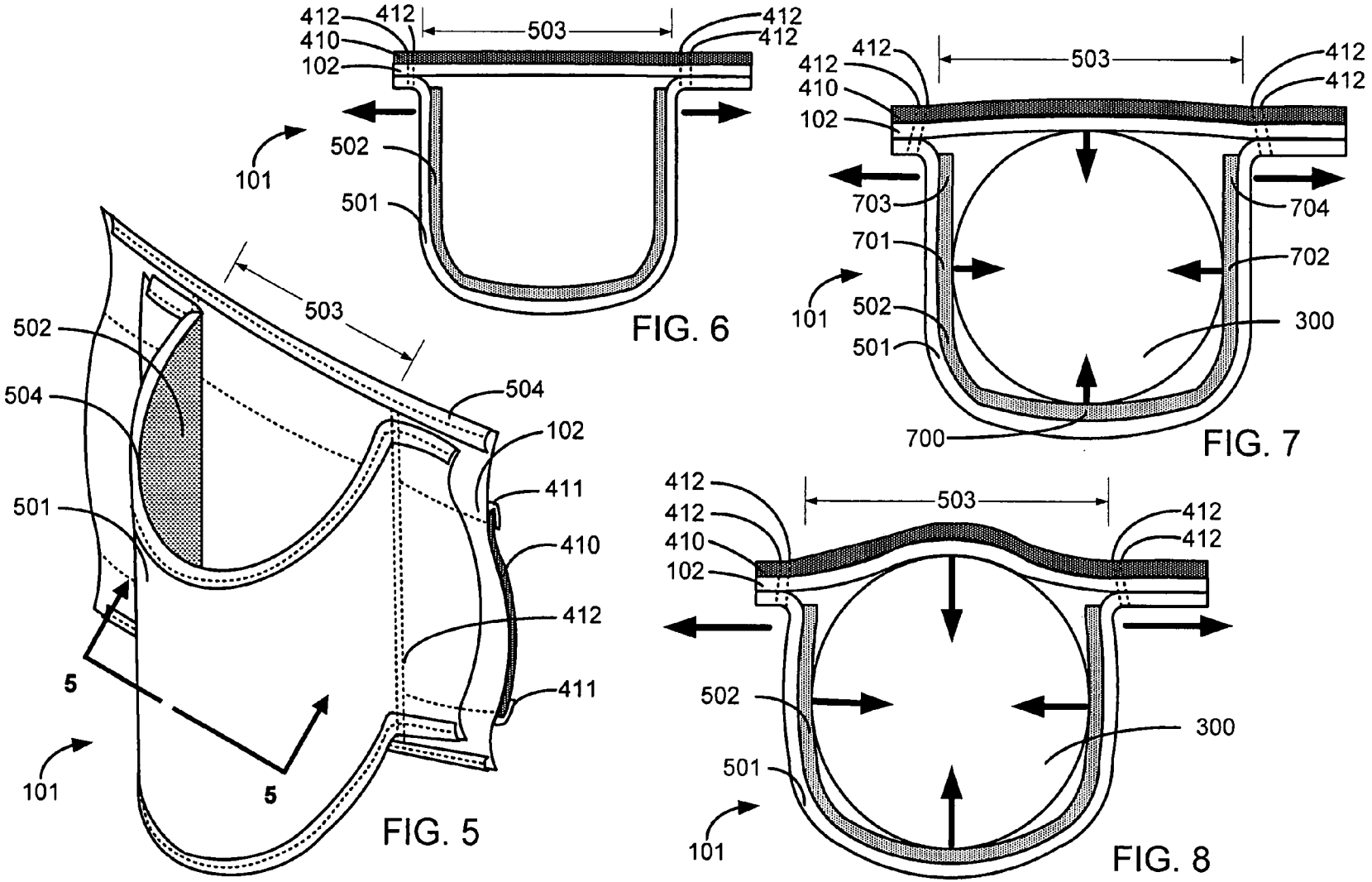
FIG. 5 shows a perspective view of one pod holder (without an elastic strap) of FIG. 1.
FIG. 6 shows a cross-sectional view through the section 5—5 of FIG. 5, illustrating the pod holder not holding a paintball pod.
FIG. 7 shows a cross-sectional view through the section 5—5 of FIG. 5, illustrating the pod holder holding a minimum-sized paintball pod.
FIG. 8 shows a cross-sectional view through the section 5—5 of FIG. 5, illustrating the pod holder holding a maximum-sized paintball pod.

FIG. 5 shows a detail of rigid paintball pod holder 101 of paintball pod holder system 100 according to the preferred embodiment of FIG. 1. In this embodiment, rigid paintball pod holder 101 preferably is sized to hold a standard 100-round or 140-round paintball pod 300. Paintball pod 300 is preferably about 10-½ inches long and about 2-¼ inches in diameter. Rigid paintball pod holder 101 is preferably about 6-½ inches long. Preferred rigid paintball pod holder 101 comprises a strip of durable, inelastic fabric 501, as shown, preferably about 6-½ inches long by about 6 inches wide. Preferred rigid paintball pod holder 101 comprises stiffener 502 (at least embodying herein the step of providing at least one stiffener; and at least embodying herein wherein the step of providing at least one stiffener further comprises the step of fabricating at least one peripheral friction controller), preferably a flat sheet (before the bending shown) of rigid plastic, resilient when bent, preferably a suitable polyurethane.

Preferably, stiffener 502 comprises at least about half the length of rigid paintball pod holder 101, preferably centered in about the middle of rigid paintball pod holder 101. More preferably, stiffener 502 comprises at least about eighty percent of the length of rigid paintball pod holder 101, preferably centered in about the middle of rigid paintball pod holder 101. Most preferably, stiffener 502 comprises substantially the entire length of rigid paintball pod holder 101 (preferably about 6-½ inches long by about 6 inches wide by about one millimeter thick). Upon reading the teachings of this specification, those with ordinary skill in the art will now understand that, under appropriate circumstances, considering such issues as advances in technology, user preference, etc., other stiffener placements, such as abutting one edge of the paintball pod holder, non-centered, etc., may suffice.

Preferably, fabric 501 and stiffener 502 are attached, preferably sewn together at the top and bottom edges, as shown (at least embodying herein wherein the step of attaching such at least one stiffener comprises the step of sewing such at least one stiffener). Preferably, edge binding 504 is applied, preferably sewn, to the edges of fabric 501 and stiffener 502, as shown. Fabric 501 is attached, preferably sewn vertically onto belt 102, preferably just outside of stiffener 502, preferably with stiffener 502 on the inside surface, preferably with a space 503 of about 2-¾ inches between the edges, as shown (at least embodying herein the step of attaching such at least one paintball pod holder to at least one wearable article; and at least embodying herein wherein the step of attaching such at least one stiffener to at least one interior of such at least one paintball pod holder further comprises the step of attaching such at least one stiffener along at least one portion of at least one inner surface of such at least one paintball pod holder). Fabric 501 is preferably heavy-duty woven nylon, as shown.

The dashed lines in FIG. 5 represent the preferred placement of stitches 412 (at least embodying herein the step of attaching such at least one stiffener to at least one interior of such at least one paintball pod holder). Upon reading the teachings of this specification, those with ordinary skill in the art will understand that, under appropriate circumstances, considering such issues as user preference, available materials, advances in technology, etc., other fabrics, such as cotton, canvas, vinyl, neoprene, etc., may suffice. Upon reading the teachings of this specification, those with ordinary skill in the art will now understand that, under appropriate circumstances, considering such issues as advances in technology, user preference, etc., other arrangements, such as the stiffener being attached directly to the belt and fabric being absent, etc., may suffice.

With reference to the following-described figures and the associated below text, it is noted that theories and explanations are included to be helpful in teaching the invention, although some of these explanatory contents may be tentative and/or partial.

FIG. 6 shows a cross section of rigid paintball pod holder 101. This drawing shows section 5—5 from FIG. 5, where rigid paintball pod holder 101 is empty. Stiffener 502 preferably exerts a natural spring force outward at the edges, as shown with force vector arrows, forming a cylindrical vertical clip. This spring force preferably keeps belt section 503 in tension and also preferably keeps the top and bottom openings open, as shown. Stiffener 502 is preferably primarily rigid in the vertical direction, as shown, permitting convenient insertion of paintball pods 300.

FIG. 7, similarly to FIG. 6, shows a section 5—5 of rigid paintball pod holder 101 but with a 100-round paintball pod 300 inserted. Paintball pod 300 preferably touches the inside of rigid paintball pod holder 101 in four places, as shown. Spring forces at the ends 703 and 704 of stiffener 502 preferably provide tension which presses belt section 503 against paintball pod 300 and in turn preferably presses paintball pod 300 against the front section 700 of rigid paintball pod holder 101, preferably resulting in a front-back force couple holding paintball pod 300, as shown. Paintball pod 300 preferably also presses against sides 701 and 702, preferably forcing sides 701 and 702 outward, preferably resulting in a side—side force couple which holds paintball pod 300, forming a vertical spring clip, as shown. This force against sides 701 and 702 also preferably adds more force to the outward spring force of ends 703 and 704, as shown.

FIG. 8, similarly to FIG. 7, shows a section 5—5 of a rigid paintball pod holder but with a larger-diameter standard 140-round paintball pod 300 inserted. The forces involved are preferably on the same vectors as in FIG. 7, but are of a larger magnitude, as shown by longer arrows. Also, due to the greater deformation of rigid paintball pod holder 101, there is preferably a greater area of contact between rigid paintball pod holder 101 and paintball pod 300 than in FIG. 7, as shown, preferably resulting in increased friction between them. This capacity for deformation preferably permits rigid paintball pod holder 101 to hold paintball pods 300 with varying sizes, as shows.

Preferably, the spring force of stiffener 502 is selectable by selecting the materials and dimensions of stiffener 502. As is known in the art of materials selection, a thin plastic stiffener may provide a minimal spring force while a thicker metal stiffener may provide much more spring force, for example. Upon reading the teachings of this specification, those of ordinary skill in the art will understand that, under appropriate circumstances, considering such issues as advancing technologies, differing costs of materials, differing pod constructions, spring technology considerations, etc., other arrangements, such as modifying the initial flat shape of the spring to other shapes, engineering different numbers of contact surfaces with the paintball pod, providing stiffeners/springs with multiple parts connected by a separate tension-providing mechanism (for example, rigid slats running the length of a pod tube), etc., may suffice.

Preferably, the coefficient of friction of stiffener 502 is adjustable by selecting the materials and surface characteristics of stiffener 502. Upon reading the teachings of this specification, those with ordinary skill in the art will now understand that, under appropriate circumstances, considering such issues as advances in technology, user preference, materials characteristics, etc., other means of controlling friction, such as smooth, rough, or bumpy textures, lubricants, rosins, coatings, or linings applied to the inner surface of the stiffener to adjust the coefficient of friction, etc., may suffice.

Upon reading the teachings of this specification, those with ordinary skill in the art will now understand that, under appropriate circumstances, considering such issues as advances in technology, user preference, etc., other stiffener materials, such as metal, rigid leather, stiff rubber, laminates, composites, fiberglass, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

ADDITIONAL EMBODIMENTS

Belt 102 at least embodies herein a plurality of paintball pod holders, each having at least one length and at least one periphery, each structured and arranged to hold at least one paintball pod.

Belt 102 at least embodies herein at least one belt structured and arranged to support such plurality of paintball pod holders.

Elastic paintball pod holder 103 at least one elastic paintball pod holder adapted to elastically hold at least one paintball pod.

Non-slip surface 410 at least embodies herein at least one non-slip surface adapted to secure such at least one belt against slipping on the at least one user during play.

Non-slip surface 410 at least embodies herein at least one non-slip surface structured and arranged to secure such at least one wearable article, when worn by the at least one user, against slipping.

Rigid paintball pod holder 101 at least embodies herein at least one paintball pod holder, having at least one length and at least one periphery, structured and arranged to hold at least one paintball pod.

Paintball pod 300 at least embodies herein at least one paintball pod.

Stiffener 502 at least embodies herein at least one peripheral friction controller structured and arranged to control at least one peripheral frictional force exerted by such at least one inner surface of such at least one stiffener when the at least one paintball pod is situate within such at least one paintball pod holder.

Stiffener 502 at least embodies herein at least one stiffener, having at least one inner surface, adapted to stiffen such at least one length of such at least one paintball pod holder.

Belt 102 at least embodies herein at least one wearable article structured and arranged to support such at least one paintball pod holder.

Non-slip surface 410 at least embodies herein non-slip surface means for securing such wearable article means, when worn by the at least one user, against slipping.

Rigid paintball pod holder 101 at least embodies herein paintball pod holder means, having at least one length and at least one periphery, for holding at least one paintball pod.

Stiffener 502 at least embodies herein peripheral friction controller means for controlling peripheral friction exerted on the at least one paintball pod by such at least one inner surface of such stiffener means when the at least one paintball pod is situate within such paintball pod holder means.

Belt 102 at least embodies herein wearable article means for supporting such paintball pod holder means.

Fabric 501 at least embodies herein wherein such at least one paintball pod holder comprises at least one fabric.

Belt 102 at least embodies herein wherein such at least one paintball pod holder comprises at least one portion of such at least one wearable article.

Stiffener 502 at least embodies herein wherein such at least one peripheral friction controller comprises at least one frictional surface structured and arranged to control at least one coefficient of friction of such at least one inside surface of such at least one paintball pod holder.

Stiffener 502 at least embodies herein wherein such at least one peripheral friction controller comprises at least one spring clip adapted to resiliently force such at least one inner surface of such at least one stiffener against the at least one paintball pod when the at least one paintball pod is situate in such at least one paintball pod holder.

Stiffener 502 at least embodies herein wherein such at least one plastic comprises at least one polyurethane.

Stiffener 502 at least embodies herein wherein such at least one plastic comprises at least one thin flat sheet.

Stiffener 502 at least embodies herein wherein such at least one stiffener comprises at least one plastic.

Stiffener 502 at least embodies herein wherein such at least one stiffener lies at least between at least one portion of such at least one paintball pod holder and the at least one paintball pod when the at least one paintball pod is situate in such at least one paintball pod holder.

Belt 102 at least embodies herein wherein such at least one wearable article comprises at least one adjustably-closeable belt adapted to adjustably close about at least one waist of the at least one user.

Elastic strap 106 at least embodies herein at least one paintball pod ejector adapted to at least partially eject the at least one paintball pod from said at least one paintball pod holder.

Non-slip pad 107 at least embodies herein wherein said at least one paintball pod ejector comprises at least one non-slip surface adapted to assist preventing slipping between said at least one paintball pod ejector and the at least one paintball pod.

Non-slip pad 107 at least embodies herein wherein said at least one non-slip surface comprises at least one neoprene pad.

Stiffener 502 at least embodies herein wherein said at least one stiffener comprises at least about fifty percent of said at least one length of said at least one paintball pod holder.

Stiffener 502 at least embodies herein wherein said at least one stiffener comprises substantially all of said at least one length of said at least one paintball pod holder.

Stiffener 502 at least embodies herein wherein said at least one stiffener is substantially centered along said at least one length of said at least one paintball pod holder.

The invention claimed is:

1. A paintball pod holder system, for use by at least one user playing paintball, comprising:

a) at least one paintball pod holder, having at least one length and at least one periphery, structured and arranged to hold at least one paintball pod;

b) at least one wearable article structured and arranged to support said at least one paintball pod holder;

c) at least one stiffener, having at least one inner surface, adapted to stiffen at least one substantial portion of said at least one length of said at least one paintball pod holder; and d) at least one peripheral friction controller structured and arranged to control at least one peripheral frictional force exerted by said at least one inner surface of said at least one stiffener when the at least one paintball pod is situate within said at least one paintball pod holder;

e) at least one paintball pod elector adapted to at least partially eject the at least one paintball pod from said at least one paintball pod holder.

2. The paintball pod holder system, according to claim 1, further comprising at least one non-slip surface structured and arranged to secure said at least one wearable article, when worn by the at least one user, against slipping.

3. The paintball pod holder system, according to claim 1, wherein said at least one wearable article comprises at least one adjustably-closeable belt adapted to adjustably close about at least one waist of the at least one user.

4. The paintball pod holder system, according to claim 1, wherein said at least one paintball pod holder comprises at least one fabric.

5. The paintball pod holder system, according to claim 1, wherein said at least one paintball pod holder comprises at least one portion of said at least one wearable article.

6. The paintball pod holder system, according to claim 1, wherein said at least one stiffener lies at least between at least one portion of said at least one paintball pod holder and the at least one paintball pod when the at least one paintball pod is situate in said at least one paintball pod holder.

7. The paintball pod holder system, according to claim 1, wherein said at least one peripheral friction controller comprises at least one frictional surface structured and arranged to control at least one coefficient of friction of said at least one inside surface of said at least one paintball pod holder.

8. The paintball pod holder system, according to claim 1, further comprising the at least one paintball pod.

9. The paintball pod holder system, according to claim 1, wherein said at least one paintball pod holder comprises at least one passage for allowing top loading of the at least one paintball pod into said at least one paintball pod holder.

10. The paintball pod holder system, according to claim 1, further comprising:

a) at least one non-slip surface structured and arranged to secure said at least one wearable article, when worn by the at least one user, against slipping;

b) wherein said at least one wearable article comprises at least one adjustably-closeable belt adapted to adjustably close about at least one waist of the at least one user;

c) wherein said at least one paintball pod holder comprises at least one fabric;

d) wherein said at least one paintball pod holder further comprises at least one portion of said at least one wearable article;

e) wherein said at least one stiffener comprises at least one plastic;

f) wherein said at least one plastic further comprises at least one thin flat sheet;

g) wherein said at least one stiffener lies at least between at least one portion of said at least one paintball pod holder and the at least one paintball pod when the at least one paintball pod is situate in said at least one paintball pod holder;

h) wherein said at least one non-slip surface comprises at least one neoprene pad;

i) wherein said at least one stiffener further comprises at least about eighty percent of said at least one length of said at least one paintball pod holder.

11. The paintball pod holder system, according to claim 1, wherein said at least one paintball pod ejector comprises at least one non-slip surface adapted to assist preventing slipping between said at least one paintball pod ejector and the at least one paintball pod.

12. The paintball pod holder system, according to claim 11, wherein said at least one non-slip surface comprises at least one neoprene pad.

13. The paintball pod holder system, according to claim 1, wherein said at least one stiffener comprises at least one plastic.

14. The paintball pod holder system, according to claim 13, wherein said at least one plastic comprises at least one polyurethane.

15. The paintball pod holder system, according to claim 13, wherein said at least one plastic comprises at least one thin flat sheet.

16. The paintball pod holder system, according to claim 1, wherein said at least one stiffener comprises at least about fifty percent of said at least one length of said at least one paintball pod holder.

17. The paintball pod holder system, according to claim 16, wherein said at least one stiffener comprises substantially all of said at least one length of said at least one paintball pod holder.

18. The paintball pod holder system, according to claim 16, wherein said at least one stiffener is substantially centered along said at least one length of said at least one paintball pod holder.

19. A paintball pod holder system, for use by at least one user playing paintball, comprising:

a) at least one paintball pod holder, having at least one length and at least one periphery, structured and arranged to hold at least one paintball pod;

b) at least one wearable article structured and arranged to support said at least one paintball pod holder;

c) at least one stiffener, having at least one inner surface, adapted to stiffen at least one substantial portion of said at least one length of said at least one paintball pod holder; and d) at least one peripheral friction controller structured and arranged to control at least one peripheral frictional force exerted by said at least one inner surface of said at least one stiffener when the at least one paintball pod is situate within said at least one paintball pod holder;

e) wherein said at least one peripheral friction controller comprises at least one spring clip adapted to resiliently force said at least one inner surface of said at least one stiffener against the at least one paintball pod when the at least one paintball pod is situate in said at least one paintball pod holder.

20. A paintball pod holder system, for use by at least one user playing paintball, comprising:

a) a plurality of paintball pod holders, each having at least one length and at least one periphery and each being structured and arranged to hold at least one paintball pod, wherein each paintball holder of said plurality of paintball holders comprises i) at least one stiffener, having at least one inner surface, adapted to stiffen at least one substantial portion of said at least one length of said at least one paintball pod holder; and ii) at least one peripheral friction controller structured and arranged to control at least one coefficient of friction of said at least one inside surface of said at least one paintball pod holder;

b) at least one belt structured and arranged to support said plurality of paintball pod holders; and c) at least one non-slip surface structured and arranged to secure said at least one wearable article, when worn by the at least one user, against slipping;

d) at least one elastic paintball pod holder adapted to elastically hold at least one paintball pod.

21. A paintball pod holder system, for use by at least one user playing paintball, comprising:

a) at least one paintball pod holder, having at least one length and at least one periphery, structured and arranged to hold at least one paintball pod;

b) at least one wearable article structured and arranged to support said at least one paintball pod holder;

c) at least one stiffener, having at least one inner surface, adapted to stiffen at least one substantial portion of said at least one length of said at least one paintball pod holder; and d) at least one peripheral friction controller structured and arranged to control at least one peripheral frictional force exerted by said at least one inner surface of said at least one stiffener when the at least one paintball pod is situate within said at least one paintball pod holder;

e) wherein said at least one paintball pod holder comprises at least one elastic.

22. A paintball pod holder system, for use by at least one user playing paintball, comprising:

a) at least one paintball pod holder, having at least one length and at least one periphery, structured and arranged to hold at least one paintball pod;

b) at least one wearable article structured and arranged to support said at least one paintball pod holder;

c) at least one stiffener, having at least one inner surface, adapted to stiffen at least one substantial portion of said at least one length of said at least one paintball pod holder; and d) at least one peripheral friction controller structured and arranged to control at least one peripheral frictional force exerted by said at least one inner surface of said at least one stiffener when the at least one paintball is situate within said at least one paintball pod holder;

e) at least one non-slip surface structured and arranged to secure said at least one wearable article, when worn by the at least one user, against slipping;

f) wherein said at least one wearable article comprises at least one adjustably-closeable belt adapted to adjustably close about at least one waist of the at least one user;

g) wherein said at least one paintball pod holder comprises at least one fabric;

h) wherein said at least one paintball pod holder further comprises at least one portion of said at least one wearable article;

i) wherein said at least one stiffener comprises at least one plastic;

j) wherein said at least one plastic further comprises at least one thin flat sheet;

k) wherein said at least one stiffener lies at least between at least one portion of said at least one paintball pod holder and the at least one paintball pod when the at least one paintball pod is situate in said at least one paintball pod holder;

l) wherein said at least one non-slip surface comprises at least one neoprene pad;

m) wherein said at least one stiffener further comprises at least about eighty percent of said at least one length of said at least one paintball pod holder;

n) said at least one paintball pod holder comprises at least one elastic;

o) wherein said at least one paintball pod holder comprises at least one top opening and at least one bottom opening structured and arranged to allow loading of the at least one paintball pod into said at least one paintball pod holder; and p) wherein said at least one peripheral friction controller comprises at least one frictional surface structured and arranged to control at least one coefficient of friction of said at least one inside surface of said at least one paintball pod holder.

23. A paintball pod holder system, for use by at least one user playing paintball, comprising:

a) at least one paintball pod holder, having at least one length and at least one periphery, structured and arranged to hold at least one paintball pod;

b) at least one wearable article structured and arranged to support said at least one paintball pod holder;

c) at least one stiffener, having at least one inner surface, adapted to stiffen at least one substantial portion of said at least one length of said at least one paintball pod holder; and d) at least one peripheral friction controller structured and arranged to control at least one peripheral frictional force exerted by said at least one inner surface of said at least one stiffener when the at least one paintball pod is situate within said at least one paintball pod holder;

e) at least one non-slip surface structured and arranged to secure said at least one wearable article, when worn by the at least one user, against slipping;

f) wherein said at least one wearable article comprises at least one adjustably-closeable belt adapted to adjustably close about at least one waist of the at least one user;

g) wherein said at least one paintball pod holder comprises at least one fabric;

h) wherein said at least one paintball pod holder further comprises at least one portion of said at least one wearable article;

i) wherein said at least one stiffener comprises at least one plastic;

j) wherein said at least one plastic further comprises at least one thin flat sheet;

k) wherein said at least one stiffener lies at least between at least one portion of said at least one paintball pod holder and the at least one paintball pod when the at least one paintball pod is situate in said at least one paintball pod holder;

l) wherein said at least one non-slip surface comprises at least one neoprene pad;

m) wherein said at least one stiffener further comprises at least about eighty percent of said at least one length of said at least one paintball pod holder;

n) said at least one paintball pod holder comprises at least one top opening and at least one bottom opening structured and arranged to allow loading of the at least one paintball pod into said at least one paintball pod holder; and o) wherein said at least one peripheral friction controller comprises at least one spring clip adapted to resiliently force said at least one inner surface of said at least one stiffener against the at least one paintball pod when the at least one paintball pod is situate in said at least one paintball pod holder.

* * * * *

UNITED STATES PATENT AND TRADEMARK OFFICE

CERTIFICATE OF CORRECTION

PATENT NO. : 7,100,810 B1
APPLICATION NO. : 10/984257
DATED : September 5, 2006
INVENTOR(S) : Bosch et al.

It is certified that error appears in the above-identified patent and that said Letters Patent is hereby corrected as shown below:

Column 11, line 57, “elector” should read --ejector--

Column 14, line 22, insert --pod-- after “paintball”

Signed and Sealed this

Twenty-third Day of January, 2007

JON W. DUDAS
*Director of the United States Patent and Trademark Office*